US006332482B1

(12) United States Patent
Runge et al.

(10) Patent No.: US 6,332,482 B1
(45) Date of Patent: Dec. 25, 2001

(54) MULTI-REFILLABLE SPRAY CAN, DEVICE FOR FILLING SAID CANS AND METHOD FOR PRODUCING SAID SPRAY CANS

(75) Inventors: Hermann Runge, Kneiting/Pettendorf; Manfred Stadler, Lappersdorf; Werner Massen, Deuerling, all of (DE)

(73) Assignee: EBB Ingenieurgesellschaft (DE)

( * ) Notice: Subject to any disclaimer, the term of this patent is extended or adjusted under 35 U.S.C. 154(b) by 0 days.

(21) Appl. No.: 09/701,381

(22) PCT Filed: Jun. 3, 1998

(86) PCT No.: PCT/DE98/01510

§ 371 Date: Dec. 1, 2000

§ 102(e) Date: Dec. 1, 2000

(87) PCT Pub. No.: WO99/62792

PCT Pub. Date: Dec. 9, 1999

(51) Int. Cl.[7] ..... B65B 1/04
(52) U.S. Cl. ..... 141/20; 141/3; 222/386
(58) Field of Search ..... 141/2, 3, 18, 20, 141/67; 222/386, 386.5, 387

(56) References Cited

U.S. PATENT DOCUMENTS 3,654,743 * 4/1972 McGeary ..... 141/20
3,915,352 * 10/1975 Scheindel ..... 222/289
3,923,208 * 12/1975 Bergloff ..... 222/386
4,877,156 * 10/1989 Clanet et al. ..... 222/386.5

* cited by examiner

*Primary Examiner*—Steven O. Douglas
(74) *Attorney, Agent, or Firm*—Hoffman Wasson & Gitler

(57) ABSTRACT

A multi-refillable spray can with a piston arranged in the cylindrical part of the interior of said can, whereby said piston has seals associated with the inner wall thereof. The area below the piston is filled with compressed air instead of the usual environmentally damaging propellant gases. The spray is accommodated in the area formed by the upper side of the piston, the lower side of the valve head and the upper inner wall of the can. The piston has a rubber valve on the upper side facing the spray, whereby the bottom of the can is fully closed.

9 Claims, 4 Drawing Sheets

MULTI-REFILLABLE SPRAY CAN, DEVICE FOR FILLING SAID CANS AND METHOD FOR PRODUCING SAID SPRAY CANS

BACKGROUND OF THE INVENTION

This invention refers to multi-refillable spray cans with a cylindrical body and tapering neck portion which is closed by means of a valve disk receiving the spray valve by which valve disk the spray fluid is filled into the can under pressure. Moreover, this invention refers to a device for filling such cans and a method for manufacturing such cans.

Spray cans (the expression „cans" also covers equivalent containers such as bottles) of the one-way type are very common and are used for receiving most different spraying liquids. The disadvantage of such cans is to be seen in that the empty cans are to be dispensed with, bearing in mind that with a large number of one-way cans the propellant gas is environmentally damaging.

Furthermore, multi-refillable cans are known which are made of a solid and heavy metal body, and which are designed for very high pressures. The armatures of such spray cans in general are made from solid brass and are expensive so that in view of the high production costs the consumer is not interested in using an expensive multi-refillable can instead of a one-way can. So far as such multi-refillable cans are acceptable from the cost point of view, an economical way of use is prevented by the facts that the empty cans are to be collected, are to be transported to a filling station, are to be refilled by using filling machines, and are to be retransported to the consumer which means a considerable expenditure in cost and time so that altogether using such multi-refillable spray cans is not or hardly not competitive. Besides of the cost for transport the main reason why such system is not successful, is to be seen in that any time such multi-refillable cans are filled with spray fluid they must be filled with propellant which, as the pressures of the fluid and the propellant within the can are to be balanced for a correct and competitive filling method requiring large systems.

From EP 0 078 936 B1 a pressurized can for spending industrial foams consisting of a foamer and a propellant is known. The can comprises an inverted bottom, a dome-type upper portion with locking means for discharging the foamer through a valve and a cylinder, within the wall of which a floating cylinder is arranged. The foamer filling is enclosed by the upper side of the piston, an upper length of the cylinder, the dome and the locking means. The propellant is arranged within a propellant space formed by the piston, a lower length of the cylinder and the can bottom. The can bottom receives a one-way valve. The piston floats up on the propellant filler. The space receiving the foamer is provided with locking means having a rubber seal of a valve. The valve body is of tube-like shape and is closed at the inner end by a valve disk which caused by the inner pressure contacts the rubber seal. If the valve body is tilted and, therefore, the valve disk is lifted, the content of the can discharges through one or several openings. The propellant is inserted from downwards through a radial opening and the valve. In order to improve the sealing effect at the valve insert (inner sealing), a cap is provided forming an outer sealing. The cap has a ring-like rubber seal.

The propellant fluid, which is a propellant gas used for this type of pressurized can, is an environmentally damaging propellant gas common for this technique so that with a can of this type the problems existing with common propellants cannot be overcome. Furthermore, the can is not designed for being refilled so that the problems caused by dispensing such cans cannot be solved.

From DE-U-90 06 569.7 a can with pressurized fluid with a foil bag is known which comprises a cylindrical container with a bottom portion and a head portion with valve. Within the lower area and beyond the piston a foil bag is arranged. Said foil bag includes the propellant. Said propellant is entrapped within the foil bag sealed against diffusion in a solid or liquid aggregate condition, and for example is $CO_2$. The piston can be a laminated piston of the type of a labyrinth sealing, whereby the lamellas are filled with sealing or blocking liquid. It can also be sealed against the can wall by means of an O-ring seal. This type of pressurized can also operates with environmentally damaging propellant and is not refillable.

It is an object of this invention to propose a spray can formed as a monoblock can (the expression „spray can" in the context of this invention also covers can-type or bottle-type spray containers so that in the following description and within the claims the general expression „cans" is used) of the type according to this invention, and to design a can so that it can be repeatedly filled, and is ready to be filled in its empty condition at any time, which means that it can be filled with filling material, that a propellant can be used which is available at any time and at low cost, and that it is free of environmental problems and also is not burnable.

A further object of this invention is to provide a device and a method for first-time and repeatedly filling such cans in a most simple manner, especially to offer very small filling stations and to have the possibility of individually filling such cans.

SUMMARY OF THE INVENTION

The present invention solves the forementioned objects in the following manner: Within the cylindrical part of the interior of the can a piston is arranged which is provided with seals associated to the inner walls of the can, the space below the piston is filled with pressurized air, the space formed by the upper side of the piston, the underside of the valve disk and the upper inner wall of the can includes the fluid to be sprayed, the spray valve is integrated within the bottom of the valve disk, and a valve is arranged within the piston at the upper side facing the fluid to be sprayed.

A corresponding spray can preferably is produced according to a method which involves the following steps:

a) a can body in cylinder form which is open at the top and has a continuous diameter over the entire height of the can is manufactured with an integrated bottom, b) within the cylindrical can body a piston is inserted from the top so that it can be moved along the cylindrical inner wall of the can body, and by sealing engagement with the inner wall the spaces above and below the piston are maintained separate from each other by means of sealing lips of the piston, c) the upper end of the cylindrical can body is deformed towards the neck of the can and is flanged, d) the can body below the piston is filled with pressurized air through a rubber valve provided within the piston by means of a filling needle, e) a valve disk with a spray valve is inserted at the upper can valve and the valve disk is clinched with the can, and f) the spray material is passed into the can between the valve disk and the piston by means of a filler spike through the spray valve of the valve disk.

A device for filling such spray cans is characterised by the following steps:

a) a rack which forms the filling station, b) a filling piston with a filling container, which is supplied with the fluid to be filled through a suction line from a supply container, the filling piston being attached to the rack, c) a non-return and overpressure valve within the suction line, d) a filler needle at the piston end facing the valve disk of the can, which filler needle is associated to the spray valve within the valve disk, and which opens the spray valve when extending the filler piston so that fluid from the supply container for filling a can is made available, and e) a foot at the rack which positions the can to be filled centrally to the filler needle.

According to this invention the piston is inserted into the spray can before the head resp. the neck of the can is formed, said piston is sealingly and movably arranged within the piston, and the position of the can is determined by the pressure of the pressurized air acting as a propellant and the counterpresusre of the spray fluid, as the filler medium. The space between the piston and the bottom of the can is closed. For filling this space a valve is provided at the upper side of the piston. As soon as the space is filled with pressurized air when activating the can for the first time, the valve opening is closed and remains closed so that the space between the piston and the valve disk is filled with the filling medium.

The pressure acting upon the piston by the pressurized air from below, and the counterpresusre acting upon the piston by the pressurized spray fluid are balanced in view of each other in such a manner that the spray fluid is under sufficiently high pressure that it can be sprayed. In order to restrict the pressure of the pressurized air, the pressure ratio at both sides of the pressure piston is chosen so that the piston is adjusted about half way of the height of the can, and the air pressure is sufficiently high so that also with a can which is nearly empty, which means that the filling of the can has been substantially discharged the remains can be sprayed with sufficiently high pressure.

The piston within the can is formed in such a manner that at its underside a sealing lip is provided, which extends circularly along the peripheral direction of the surface of the piston, which lip is directed downwardly and outwardly so that in view of the pressure exerted by the pressurized air upwardly onto the piston, the sealing lip is forced apart so that the sealing effect onto the inner peripheral surface of the can is increased. Correspondingly, a ring-type sealing lip is provided distant from said first-mentioned sealing lip which extends upwardly and outwardly, and which in view of the pressure effect of the spray fluid between the valve disk and the piston is forced apart outwardly so that an increased sealing effect onto the inner peripheral wall of the can is obtained, which guarantees that spray fluid also under pressure is prevented from flowing downwards across the piston. For improving the sealing effect the inner wall of the can and/or the peripheral surface of the piston is provided with a layer of sealing material, such as Teflon (a registered trademark), especially around the sealing lips; furthermore, the sealing lips preferably are designed as lengthy lip seals in order to improve the sealing effect. At the upper area facing the valve disk the piston is curved inwardly and upwardly corresponding to the neck of the can, and at the inner part is formed like a cup corresponding to the shape of the valve disk so that the valve disk with spraying valve is received within said cup. Preferably, the piston is hollow and is provided with reinforcing elements, namely as inner cylindrical hub and web-type walls extending in a radial direction from this hub towards the outer surface. The piston is preferably made from plastics, however, can also be made from metal, whereby the sealing lips when designed from a plastics also can be made from plastics or alternatively can be rubber seals, if the piston is made from metal.

The cans are filled by means of a device with a rack on which the can or bottle to be filled is detached in a defined position. Above the can the rack is preferably electrohydraulically driven piston with a cylindrical container is arranged, which includes the predetermined amount of filling material to be filled into the can; at the lower end of the rack a filler needle is provided which is exactly associated to the can underneath, and which when activating the electrohydraulic filler piston engages the spraying valve and opens it for starting the filling operation. The filling material is passed from a storage container through a suction pipe into the filling container in which the filler piston is arranged, whereby the supplied volume of spray material is the exact amount to be filled into the can. Between the suction line and the container to be filled a non-return and overpressure valve is provided which is designed so that with a filling movement of the piston the liquid will not be passed into the suction line, but exclusively into the can to be filled, and furthermore so that with corresponding calibration the can to be filled cannot be overfilled.

The can to be filled is designed as a seamless or monoblock can or bottle made from aluminum or plastics. This allows to keep the weight very low.

The material to be sprayed can be any fluid, for example any technical liquids such as lubricant oil, etc., spray fluid as are used for caring hair, high or low viscous creams, foams (at lower pressure) and the like.

The advantages of the subject invention especially are to be seen in that the spray can or spray bottle can be refilled repeatedly, that when refilling the spray material, refilling of the propellant can be dispensed with entirely, that air can be used as a propellant which is available anywhere and without any cost, that the can or the bottle is of no harm to the environment, because on the one hand it can be refilled again and again, and because on the other hand the propellant is air which does no harm at all, that the cost for filling can be decreased considerably, and that a separate air supply for filling a propellant within a filling station according to common methods is dispensed with. With the subject invention it is also possible for very small filling stations to repeatedly fill spray cans or spray bottles individually on the spot so that for example within a hair dresser's saloon emptied spray cans be refilled without any problems, in a fast and very cheap manner and, therefore, can be repeatedly used. Because the can or bottle will be flanged only subsequent to the insertion of the piston it is not possible to notice from outside that a spray can or a spray bottle is involved which is basically different from common spray cans or spray bottles.

A further, important advantage of the invention results from the fact that the space of the can which is entirely closed at the bottom area filled with pressurized air below the piston remains filled unchanged during the entire use of the can so that the pressurized air once filled into the can and also the energy used for such filling operation is saved, whereas the fluid to be sprayed can be repeatedly refilled if it is discharged from the spray can. If the spray can is to be dispensed with pressurized air flows into the atmosphere and will be absorbed by the atmosphere without any damage to the environment.

BRIEF DESCRIPTION OF THE DRAWINGS

In the following, the invention is described in connection with the drawings by embodiments of the invention. The figures show.

DETAILED DESCRIPTION

Figure 1:
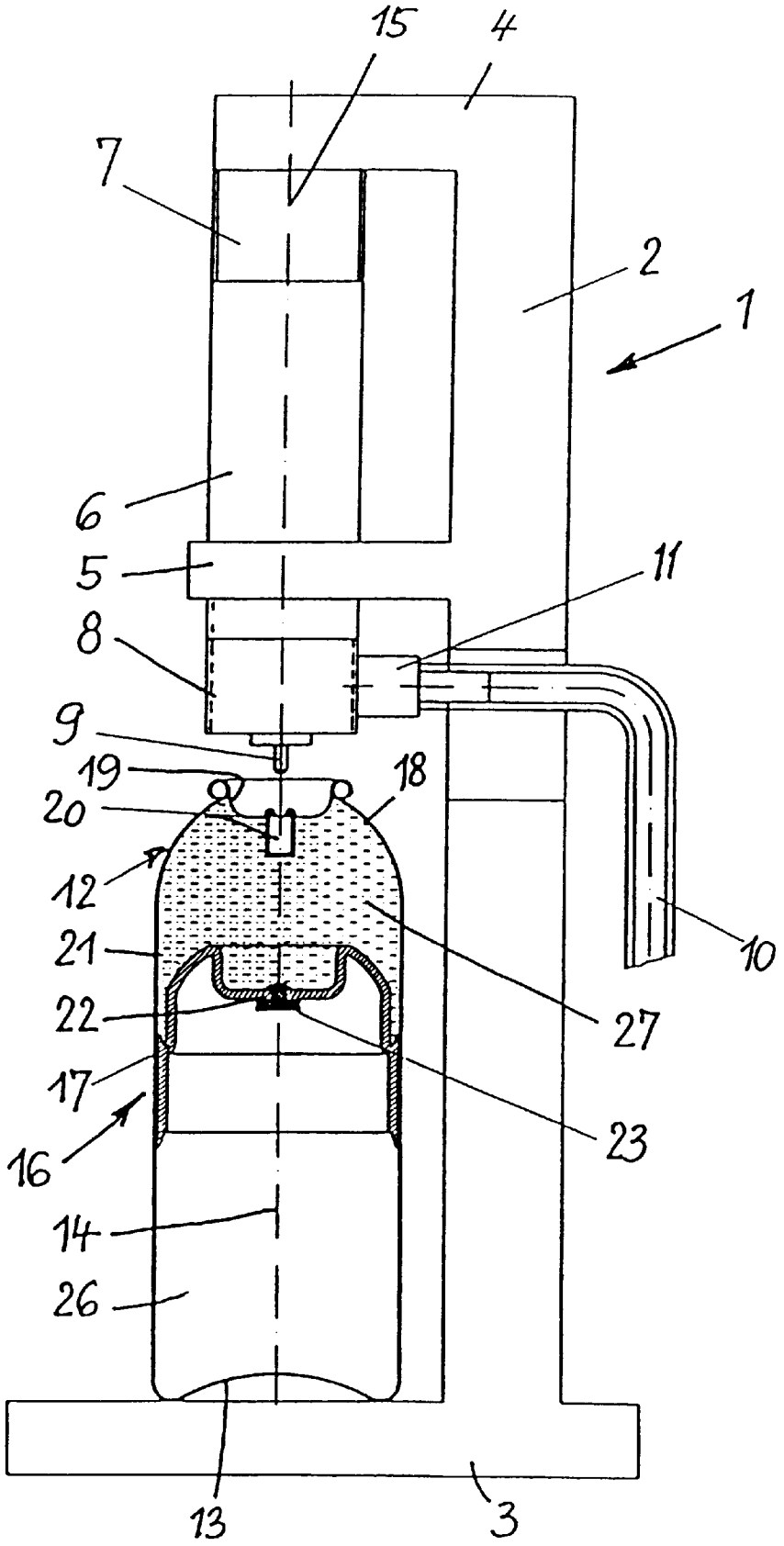
FIG. 1 a device for filling a refillable can.

On a rack 1 with a vertical stand 2 and a bottom plate 3 an upper support arm 4 and a lower support arm 5 are provided, between which a filler container 6 for receiving the material to be filled is arranged. The container receives a piston 7. A hand-operated lever can be provided instead of a piston drive as an alternative for hand-driven devices. The volume of the filling in the container 6 is designed according to the amount of spray fluid to be discharged. FIG. 1 at 7 shows the upper position of the piston which can be driven electrohydraulically, and at 8 shows the piston in its lower position. At the lower end of the filling container 6 holding the filling a filler needle 9 is provided by means of which the transfer of spray fluid is performed. The spray fluid is delivered from a (not shown) storage supply through a suction line 10 and a non-return and overpressure valve 11 with the lower end of the container 6 connected so that for starting the filling operation the container 6 will be completely filled with the piston 7 arranged in its upper position. This volume of spray fluid will be filled under pressure of the piston 7 into the refillable can 12 arranged on the bottom plate 3. The can 12 has a bottom 13 which is positioned at the bottom plate 3 so that the central axis 14 of the can 12 is in line with the central axis 15 of the filler piston 7. Using a calibrated non-return or overpressure valve forms safety means against pressure caused by overfilling. The pressure used for the filling operation is adjustable dependent on the materials and cans to be filled. The required filling amount can be stored provisionally within the piston and can be filled into the can in doses. In this way, any cans made from sheet metal or plastic, bottles made from glass or plastic, pressure containers made from aluminum or any other suitable material and the like can be filled without any problems and in very simple manner.

Figure 2:
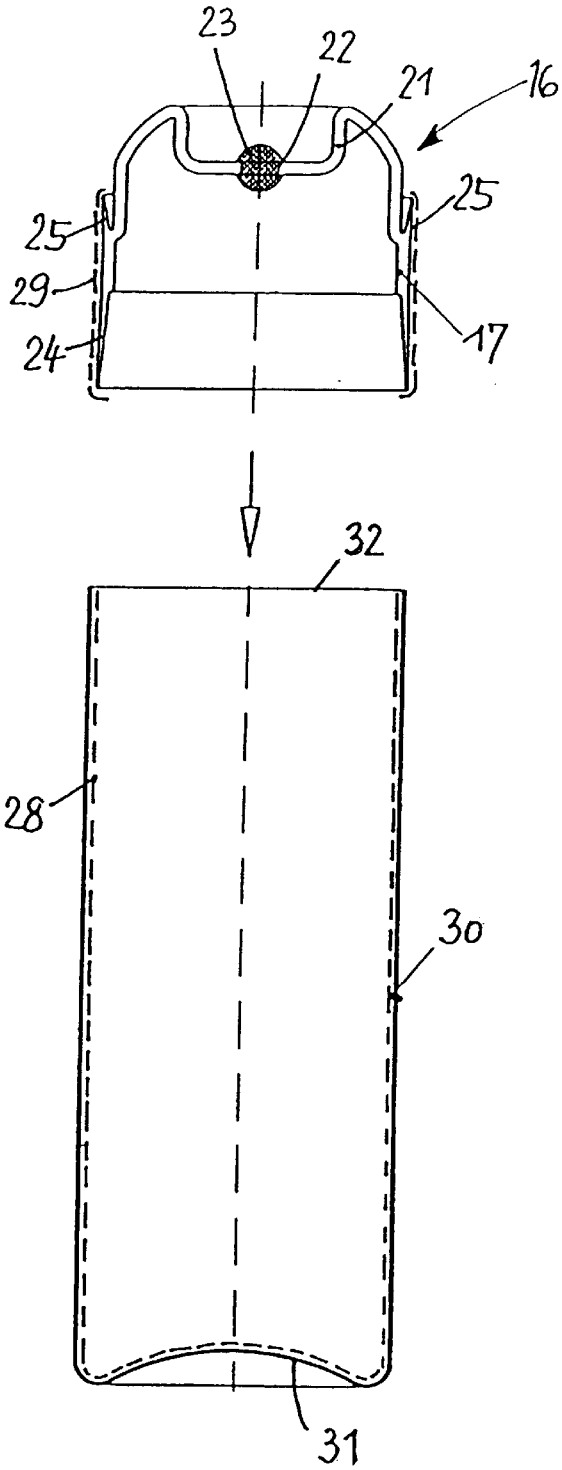
FIG. 2 a refillable can in its starting condition during the manufacturing process, with separately shown piston, FIG. 3 a refillable can according to FIG. 2 with the piston inserted, FIG. 4 a refillable can according to FIG. 3 with deformed neck, and filled with pressurized air, FIG. 5 a refillable can according to FIG. 4 with clinched valve disk, FIG. 6 a refillable can according to FIG. 4 with filled-in spray fluid, FIG. 7 a valve disk with spray valve according to FIG. 5.

Within the refillable can 12 a can piston 16 (preferably made of plastic) is arranged, which is a circular in cross-section and which is sealingly movable along the cylindrical portion of the interior periphery of the can 12 in an axial direction 14. It is provided with a ring-like section 17 the outer periphery of which has a circumferential seal. The neck 18 of the can 12 is inwardly shaped like a dome into an aperture of the can which is provided with a valve disk 19 closing the can aperture. A spray valve 20 is provided within the valve disk 19 as a female valve. The upper, deep-drawn edge 21 of the piston is provided with an aperture 22 for receiving a valve 23 which can be designed in a conventional manner, for example made from rubber, plastic or metal (ball valve), through which the pressurized air resp. pressurized gas is discharged into the section underneath the piston 16. The ring-like seal 17 of piston 16 has (as shown in FIG. 2) a lower ring-like lip seal 24 the lip of which is directed downwards and outwards, and by means of the pressurized air filling 26 exerting a pressure within the can volume is stretched outwardly, and accordingly is urged into contact with the inner surface of the refillable can 12. Piston 16 is provided with an upper lip seal 25 which is directed upwards and outwards, and by means of the pressure of the spray fluid 27 above piston 16 is urged downwards and outwards so that also this lip seal under pressure contacts the inner surface of the refillable can 12 positively. Piston 16 within the refillable can 12 is designed as a hollow body and has reinforcing, radially extending web walls and a cylindrical resp. hub-type portion, both of which are not shown. In this manner the piston has a high degree of stability and at the same time a low weight.

In order to improve the sealing effect of the piston 16 at the sealing lips 24 and 25 at the inner wall of the can to a further extent, the inner wall of the can and/or the peripheral surface of the piston 16, especially adjacent the sealing lips 24 and 25, is provided with a sealing layer 28, 29 made from Teflon or similar material.

Figure 3:
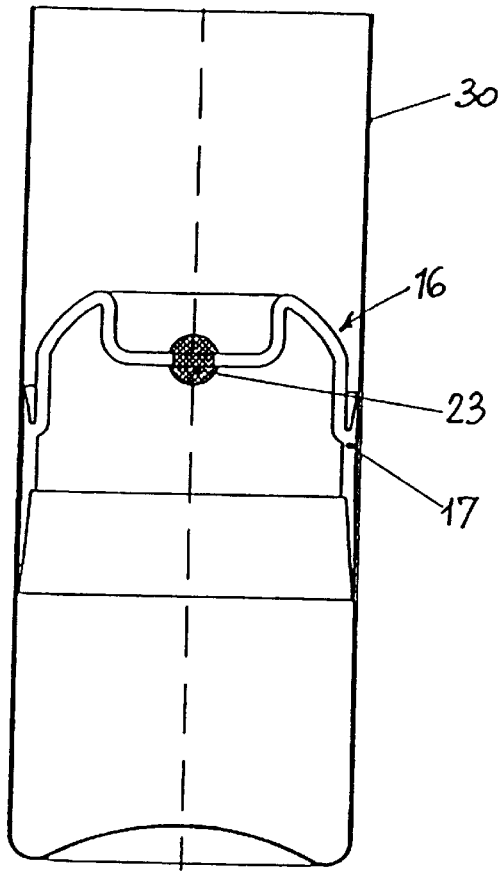
Figure 4:
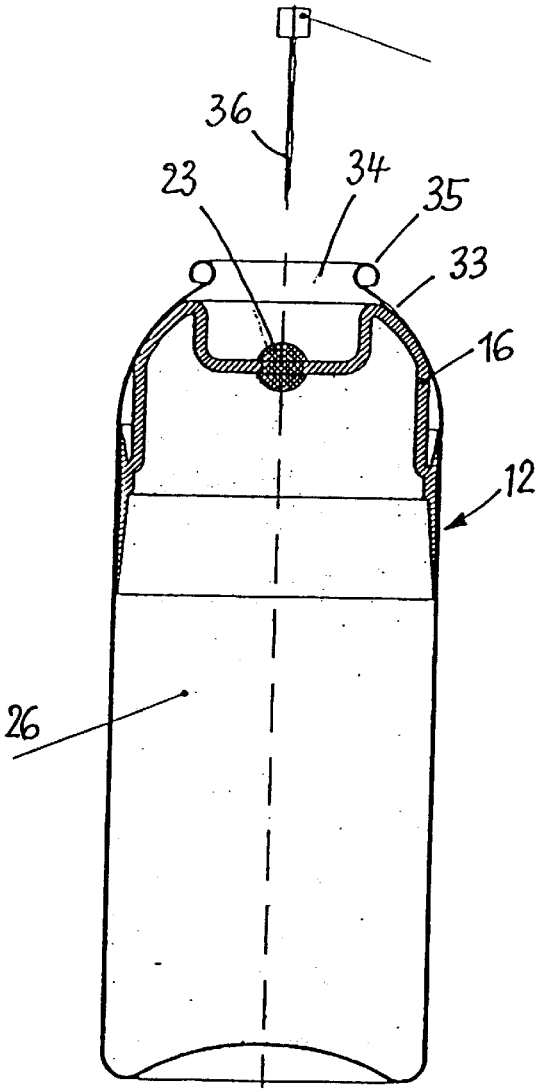
Figure 5:
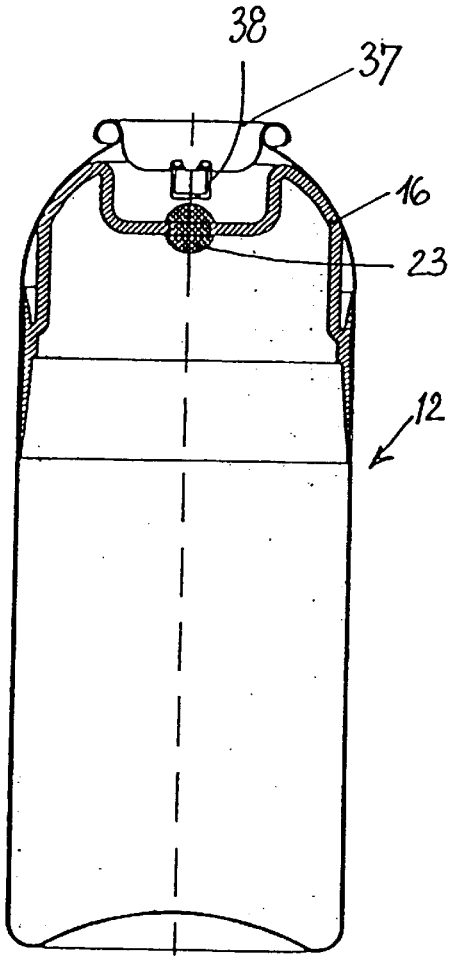
Figure 6:
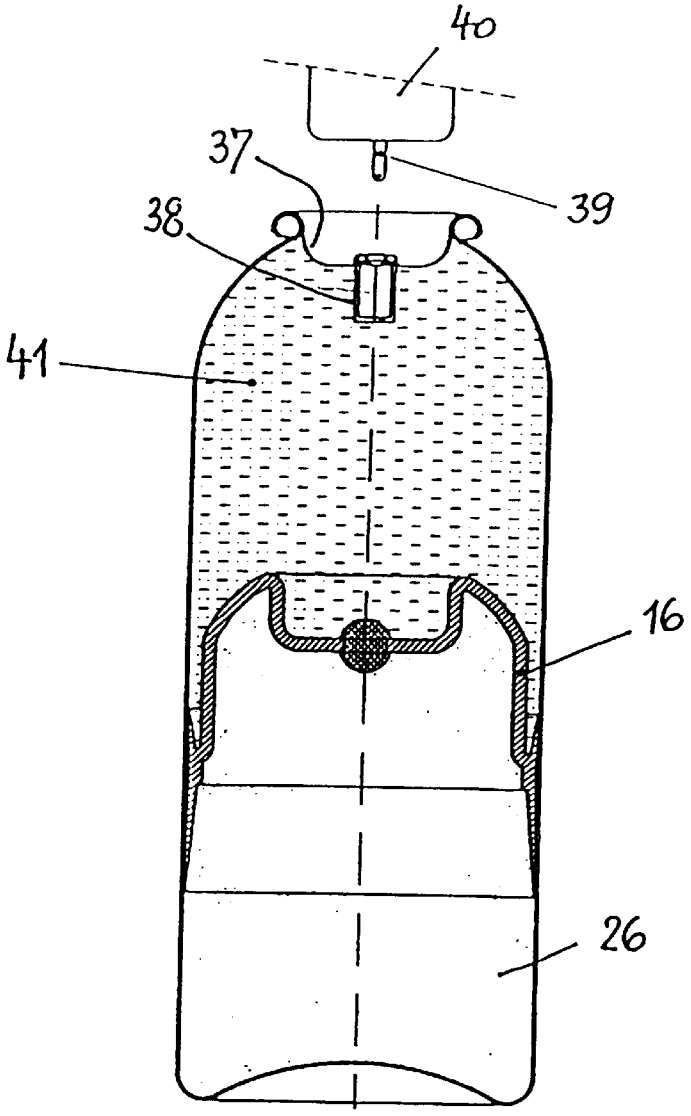
Figure 7:
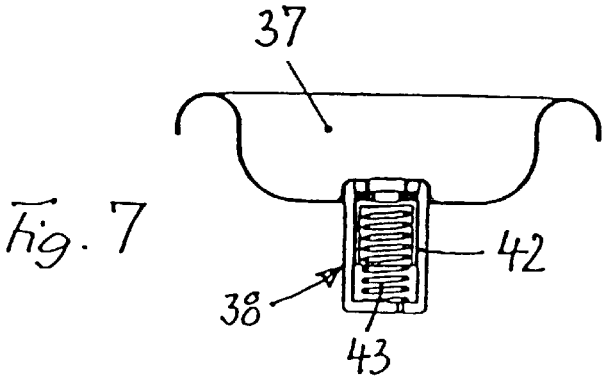

FIG. 2 shows the monoblock can 30 in its original condition; the inner edge is free of seams and has a Teflon coating 28. The tubular cylinder 30 with integrated bottom 31 is open at the upper end 32 so that the piston 16 can be inserted into the cylinder (as shown in FIG. 3). Subsequent to inserting the piston 16 into the cylinder 30 the head portion of the cylinder 30 (as shown in FIG. 4) is formed into a dome 30 with an aperture 34, the peripheral edge of which is flanged at 35. Subsequent thereto can 30 by means of a filler needle 36 is filled with pressurized air which is passed into the cylinder through valve 23. Valve 23 can be a rubber valve, and the filler needle 36 has a diameter so small that rubber valve 23 subsequent to withdrawing the filler needle 36 closes automatically. Then, valve disk 37 is attached to valve 38 (which corresponds with the valve disk 19 and valve 20 of FIG. 1), and is clinched to the flanged peripheral edge 35 of the can. In this manner, the space between a valve disk 37 and the upper side of the piston is positioned and sealed. Through a spike 39 of a fluid filling device 40 the spray fluid is passed into space 41 receiving the spraying fluid, and in view of the exerted pressure piston 16 is urged downwards against the pressure effect of the pressurized air filling.

Valve 38, which is integrated into the valve disk 37 is a spray valve without a star which within a casing 42 receives a pressure spring.

What is claimed is:

1. A refillable monoblock spray can with a cylindrical body and a conical neck portion which is closed by means of a spray valve receiving a valve disk through which fluid under pressure is filled into the can, comprising:

a) a piston positioned within a cylindrical portion of an interior of the can, said piston is provided with seals associated to an inner peripheral wall of the can, b) a space underneath said piston is filled with pressurized air forming a propellant, c) said space formed by an upper side of said piston, a lower side of said valve disk and said upper inner wall of said can receives a fluid to be sprayed, d) said spray valve is integrated into a bottom of the valve disk, and e) a valve is arranged within said piston at said upper side facing said fluid to be sprayed.

2. The refillable monoblock spray can according to claim 1, wherein said piston is a metal or plastic member, which at a lower outer edge has a sealing lip arranged and shaped in such a manner that with an upward pressure acting upon said piston, said lip is spread outwardly and seals between said inner surface of the can and a peripheral surface of the piston, which is provided with a sealing lip in an intermediate area, which sealing lip with a pressure acting upon said upper side of the piston spreads outwardly and seals between said inner surface of the can and said peripheral surface of the piston, and which in said upper area is adapted to a shape of said conical section of said can body.

3. The refillable monoblock spray can according to claim 1, wherein said piston is a central, deep-drawn, cup-like recess adapted in shape to a shape of the valve disk, and has a ring-like peripheral wall at said upper and said lower end of which one of ring-like sealing lips each is provided.

4. The refillable monoblock spray can according to claim 1, wherein an interior of said piston is provided with lamella-type reinforcement elements.

5. The refillable monoblock spray can according to claim 1, wherein said inner wall of said can and/or said peripheral wall of the piston, at the sealing lips, is provided with a coating.

6. A method for manufacturing said refillable monoblock spray cans according to claim 1, which are filled with spray fluid under pressure, said fluid being sprayed off by operating a spray valve, wherein a) a can body of cylindrical shape which is open at a top and has a continuous diameter over the entire height of the can is manufactured with an integrated bottom, b) a piston within said cylindrical can body is inserted from said top so that it can be moved along said cylindrical inner wall of the can body, and by a sealing engagement with said inner wall the spaces above and below said piston are maintained separate from each other by means of sealing lips of said piston, c) said upper end of said cylindrical can body is deformed towards a neck of said can and is flanged, d) said can body below said piston is filled with pressurized air through a valve provided within said piston by means of a filling needle, e) a valve disk with a spray valve is inserted at said upper can valve and said valve disk is clinched with said can, and f) a spray material is passed into said can between said valve disk and said piston by means of a filler spike through said spray valve of said valve disk.

7. A device for filling refillable spray cans according to claim 1, comprising a combination of the following features:

a) a rack which forms a filling station, b) a filler piston with a filling container, which is supplied with a fluid to be filled through a section line from a supply container, a filler piston being attached to said rack, c) a non-return and an over pressure valve within said suction line, d) a filler needle at the piston end facing said valve disk of the can, which filler needle is associated to said spray valve within said valve disk and opens said spray valve when extending said filler piston so that fluid from said supply container for filling a can is made available, and e) a foot on said rack which positions said can centrally to said filler needle.

8. The device according to claim 7, wherein said filler container receiving said filler piston has a volume corresponding to a fluid amount which is to be transferred to said can.

9. The device according to claim 7, wherein an overpressure valve is a calibrated valve which prevents overfilling said can.

* * * * *